US011104550B2

(12) United States Patent
Fernandez et al.

(10) Patent No.: US 11,104,550 B2
(45) Date of Patent: Aug. 31, 2021

(54) ELEVATOR CAR AND ELEVATOR SYSTEM COMPRISING AN ELEVATOR CAR

(71) Applicant: Otis Elevator Company, Farmington, CT (US)

(72) Inventors: Juan Jose Fernandez, Madrid (ES); Juan Quiles, Rivas-Vaciamadrid (ES); Agustin Jimenez-Gonzalez, Madrid (ES)

(73) Assignee: OTIS ELEVATOR COMPANY, Farmington, CT (US)

( * ) Notice: Subject to any disclaimer, the term of this patent is extended or adjusted under 35 U.S.C. 154(b) by 257 days.

(21) Appl. No.: 16/284,244

(22) Filed: Feb. 25, 2019

(65) Prior Publication Data

US 2019/0263629 A1 Aug. 29, 2019

(30) Foreign Application Priority Data

Feb. 27, 2018 (EP) ..... 18158845

(51) Int. Cl.
*B66B 11/02* (2006.01)
*B66B 11/00* (2006.01)

(52) U.S. Cl.
CPC ..... *B66B 11/0246* (2013.01); *B66B 11/0045* (2013.01)

(58) Field of Classification Search
CPC ..... B66B 11/0246; B66B 11/0045; B66B 11/0226
See application file for complete search history.

(56) References Cited

U.S. PATENT DOCUMENTS 6,880,678 B1 * 4/2005 Schneider ..... B66B 11/0246 187/314
8,925,980 B2 1/2015 Heikintupa et al.
9,193,566 B1 * 11/2015 Nieves ..... B66B 11/0226
(Continued)

FOREIGN PATENT DOCUMENTS

CN 1078676 A 11/1993
CN 201367291 Y 12/2009
(Continued)

OTHER PUBLICATIONS

CN106698159—Machine Translation (Year: 2017).*
(Continued)

*Primary Examiner* — Michael A Riegelman
(74) *Attorney, Agent, or Firm* — Cantor Colburn LLP

(57) ABSTRACT

An elevator car (6) defining an interior space (12) for accommodating passengers comprises a support frame (22) positioned on a top side of the interior space (12); a support structure (30) pivotably mounted to the support frame (22); and a working platform (28) pivotably mounted to the support structure (30). The support structure (30) is pivotable with respect to the support frame (22) and the working platform (28) is pivotable with respect to the support structure (30) between a retracted position, in which the working platform (28) and the support structure (30) are oriented close to the support frame (22), and a deployed position, in which the support structure (30) extends away from the support frame (22) towards the interior space (12) and the working platform (28) extends away from the support structure (30).

17 Claims, 6 Drawing Sheets

(56) References Cited

U.S. PATENT DOCUMENTS

Figure 1:
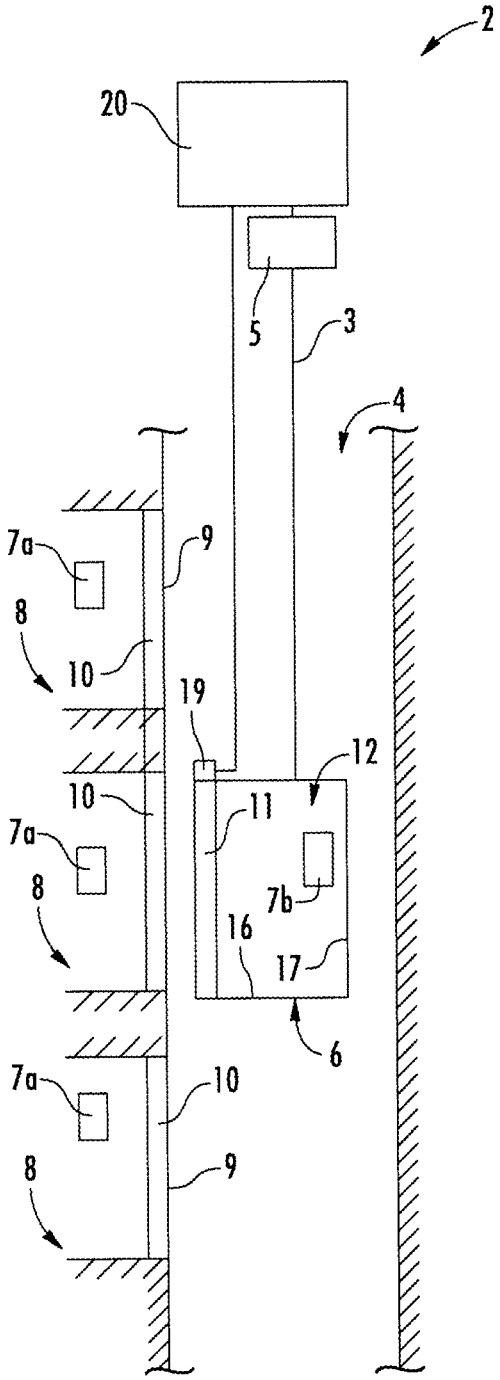

| | | | | |
|---|---|---|---|---|
| 9,546,078 | B2 * | 1/2017 | Paasisalo | B66B 11/0226 |
| 2006/0289244 | A1 * | 12/2006 | Sittier | B66B 11/0246 187/401 |
| 2007/0056809 | A1 * | 3/2007 | Fernandes | B66B 11/0246 187/401 |
| 2007/0056810 | A1 * | 3/2007 | Fernandes | B66B 5/00 187/401 |
| 2012/0085032 | A1 * | 4/2012 | Heikintupa | E04B 9/003 49/104 |
| 2018/0339879 | A1 * | 11/2018 | Quaretti | B66B 3/023 |
| 2019/0031472 | A1 * | 1/2019 | Salin | B66B 11/0226 |
| 2019/0263629 | A1 * | 8/2019 | Fernandez | B66B 11/0246 |
| 2019/0330023 | A1 * | 10/2019 | Fauconnet | B66B 11/0206 |
| 2019/0389698 | A1 * | 12/2019 | Jimenez-Gonzalez | B66B 11/0246 |

FOREIGN PATENT DOCUMENTS

| | | | |
|---|---|---|---|
| CN | 1976858 | B | 6/2011 |
| CN | 202687707 | U | 1/2013 |
| CN | 102515000 | B | 10/2013 |
| CN | 204280984 | U | 4/2015 |
| CN | 106698159 | A | 5/2017 |
| CN | 107406232 | A | 11/2017 |
| EP | 0870722 | B1 | 10/2002 |
| EP | 1988049 | A1 | 11/2008 |
| EP | 1174381 | B1 | 6/2009 |
| EP | 1728753 | B1 | 7/2009 |
| EP | 1760026 | B1 | 5/2010 |
| EP | 1433734 | B1 | 10/2011 |
| EP | 2190770 | B1 | 11/2011 |
| EP | 2456704 | B1 | 4/2016 |
| FR | 2841885 | A1 | 1/2004 |
| JP | H06278973 | A | 10/1994 |
| JP | H09263372 | A | 10/1997 |
| JP | WO2006126254 | * | 1/2006 |
| WO | 2008074168 | A1 | 6/2008 |
| WO | 2017157468 | A1 | 9/2017 |

OTHER PUBLICATIONS

WO2006126254—Machine translation (Year: 2006).*

Chinese Office Action and Search Report for application CN 201910145749.8, dated Mar. 31, 2020 , 7 pages.

European Search Report for application EP 18158845.0, dated Sep. 7, 2018, 7 pages.

* cited by examiner

ELEVATOR CAR AND ELEVATOR SYSTEM COMPRISING AN ELEVATOR CAR

The invention relates to an elevator car and to an elevator system comprising at least one elevator car.

An elevator system comprises at least one elevator car traveling along a hoistway between a plurality of landings. For repair and/or maintenance purposes it may be necessary for a mechanic to access the hoistway, in particular a region of the hoistway above the elevator car.

It therefore is desirable to provide means allowing a mechanic to access the region of the hoistway above the elevator car safely and conveniently.

According to an exemplary embodiment of the invention, an elevator car defining an interior space for accommodating passengers comprises a support frame positioned on a top side of the interior space; a support structure pivotably mounted to the support frame; and a working platform pivotably mounted to the support structure. The support structure is pivotable with respect to the support frame and the working platform is pivotable with respect to the support structure, so that the working platform is movable between a retracted storage position, in which the working platform and the support structure are oriented close to the support frame, and a deployed working position, in which the support structure extends away from the support frame towards the interior space and the working platform extends away from the support structure.

Exemplary embodiments of the invention also include an elevator system comprising at least one elevator car according to an exemplary embodiment of the invention.

Exemplary embodiments of the invention further include a method of moving the working platform of an elevator car according to an exemplary embodiment of the invention. The method includes pivoting the support structure with respect to the support frame and pivoting the working platform with respect to the support structure in order to move the working platform between the retracted storage position and the deployed working position.

The working platform may be pivoted with respect to the support structure separately from, or at least partially simultaneously with, moving the support structure with respect to the support frame. I.e. the working platform may be moved, in particular pivoted, together with the support structure with respect to the support frame in a first step, and the working platform may be moved, in particular pivoted, with respect to the support structure in a second step after the first step has been completed. Alternatively, the working platform may be moved, in particular pivoted, with respect to the support structure while the support structure is still moving (pivoting) with respect to the support frame.

When arranged in its deployed working position, the working platform allows a mechanic standing on the working platform to access a region of the hoistway above the elevator car safely and conveniently. As the mechanic may stay within the elevator car and in particular does not need to climb onto the roof of the elevator car, the risk of accidents is considerably reduced. Since the working platform is part of the elevator car, there is no need for the mechanic to carry a platform, a ladder or similar devices to the elevator system. When arranged in the retracted storage position, the platform is invisible to the passengers of the elevator system, and the working platform does not reduce the space available for the passengers. This feature allows having a low overhead hoistway without special compensatory measures.

A number of optional features are set out in the following. These features may be realized in particular embodiments, alone or in combination with any of the other features.

The working platform may be movable between the retracted storage position and the deployed working position through at least one intermediate position, in which the working platform is arranged in an inclined orientation with respect to the support frame and/or with respect to a floor of the elevator car. In the inclined orientation, the working platform may still be arranged close and substantially parallel to the support structure. Alternatively, in the inclined orientation of the working platform, an end of the working platform may be located in some distance from the support structure.

In the intermediate position, the working platform in particular may be oriented at an angle of 10° to 80° with respect to the support frame and/or with respect to the floor of the elevator car. The working platform is pivoted (rotated) with respect to the support frame when moved from the retracted storage position into the deployed working position and vice versa. Such a pivoting motion allows for a convenient and safe movement of the working platform between the retracted storage position and the deployed working position.

When the working platform is arranged in the deployed working position, the support structure may extend basically orthogonally from the support frame. In other words, the angle between support structure and the support frame may be between 70° and 110°, in particular between 80° and 100°, more particularly between 85° and 95°. Such geometry allows for a mechanically stable configuration.

When positioned in its deployed working position, the working platform may extend basically orthogonally from the support structure. In other words, the working platform, when positioned in its deployed working position, may extend at an angle between 70° and 110°, in particular at an angle between 80° and 100°, more particularly at an angle between 85° and 95° from the support structure. Such geometry allows for a mechanically stable configuration.

When the working platform is arranged in its retracted storage position, the angle between the support structure and support frame may be between 0° and 15°, in particular between 0° and 10°, more particularly between 0° and 5°. Such configuration allows reducing the space needed for storing the working platform and the support structure.

When arranged in its retracted storage position, the working platform may extend basically parallel to the support structure. In other words, the working platform, when arranged in its retracted storage position, may extend at an angle between 0° and 15°, in particular at an angle between 0° and 10°, more particularly at an angle between 0° and 5° with respect to the support structure. Such configuration allows reducing the space needed for storing the working platform and the support structure.

The elevator car may further comprise a linkage connected to the support frame and to the working platform. Such a linkage adds additional stability to the working platform and results in a well-controlled movement of the working platform between the retracted storage position and the deployed working position.

In particular a first end of the working platform may be pivotably connected to the support structure, and a second, opposing end of the working platform may be connected to the linkage. Such a structure efficiently enhances the stability of the working platform.

The linkage may be pivotably connected, e.g. by means of a rotatable joint, to the support frame and/or to the working platform in order to allow adjusting the orientation of the linkage to the varying orientation of the working platform in the course of its movement.

The length of the linkage may be variable in order to allow for adjusting the length of the linkage to a varying distance between an end of the working platform and the support frame in the course of the movement of the working platform. The linkage in particular may be a telescopic linkage. The linkage further may comprise a first bar and a second bar slidably connected to each other. Such a linkage may comprise a pin extending through longitudinal slots formed in each of the bars, respectively.

The linkage may comprise two linkage elements attached to two opposing lateral sides of the working platform, thus providing a symmetric configuration and allowing for a symmetric distribution of the acting forces.

The working platform may comprise a storage space. The storage space may be configured for accommodating a ladder. The storage space in particular may be formed in a lower portion of the working platform. Storing a ladder at/below the working platform allows a mechanic to climb onto the working platform more easily. There in particular is no need for the mechanic to bring his own ladder.

The ladder in particular may be a telescopic ladder. This allows a relatively long ladder, which bridges the distance between the floor of the elevator car and the working platform in its deployed working position, being stored in a comparatively small storage space, the storing space being limited by the dimensions of the working platform.

Exemplary embodiments of the invention may include extracting the ladder from the storage space and optionally unfolding the ladder in order to provide easy access to the working platform.

The elevator may further comprise a ceiling element pivotably attached to the support frame. The ceiling element in particular may be positionable between the working platform and the interior space covering the working platform, when the working platform and the support structure are oriented in their respective retracted positions. As the ceiling element is pivotably attached to the support frame, it further allows access to the working platform by moving the ceiling element out of the position in which it covers the working platform.

A method according to an exemplary embodiment of the invention may include pivoting the ceiling element from a position in which it is positioned between the working platform and the interior space into a position in which it allows access to the working platform.

The ceiling element may support or include at least one illumination element which is configured for illuminating the interior space of the elevator car. Integrating at least one illumination element with the ceiling element allows for easy access to the at least one illumination element by pivoting the ceiling element in order to allow access to the rear side of the ceiling element. The illumination element may include an LED or an arrangement of a plurality of LEDs.

The support structure, the working platform and/or the ceiling element may be lockable in at least one of their retracted and deployed positions in order to prevent an unauthorized and/or undesired movement of the working platform. The support structure, the working platform and/or the ceiling element in particular may be provided by with a lock. The lock may be unlockable only using a key which is available to authorized personnel only.

A method according to an exemplary embodiment of the invention may include locking and unlocking the support structure, the working platform and/or the ceiling element in order to selectively prevent or allow moving the working platform between its retracted storage position and the deployed working position and vice versa.

In the following an exemplary embodiment of the invention is described with reference to the enclosed figures.

FIG. 1 schematically depicts an elevator system comprising an elevator car according to an exemplary embodiment of the invention.

Figure 2:
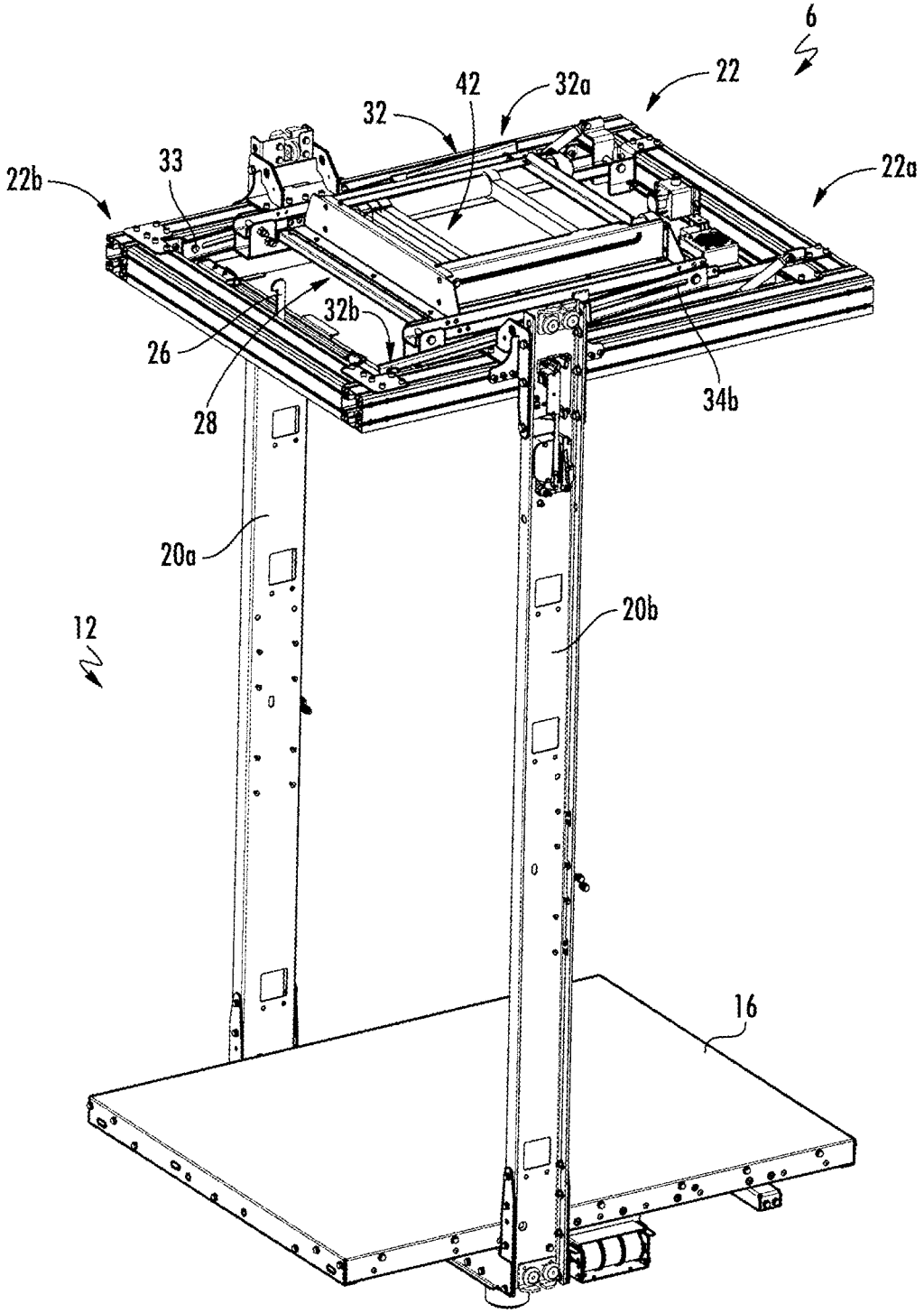

FIG. 2 shows a perspective view of an elevator car according to an exemplary embodiment of the invention comprising a working platform arranged in a retracted storage position.

Figure 3:
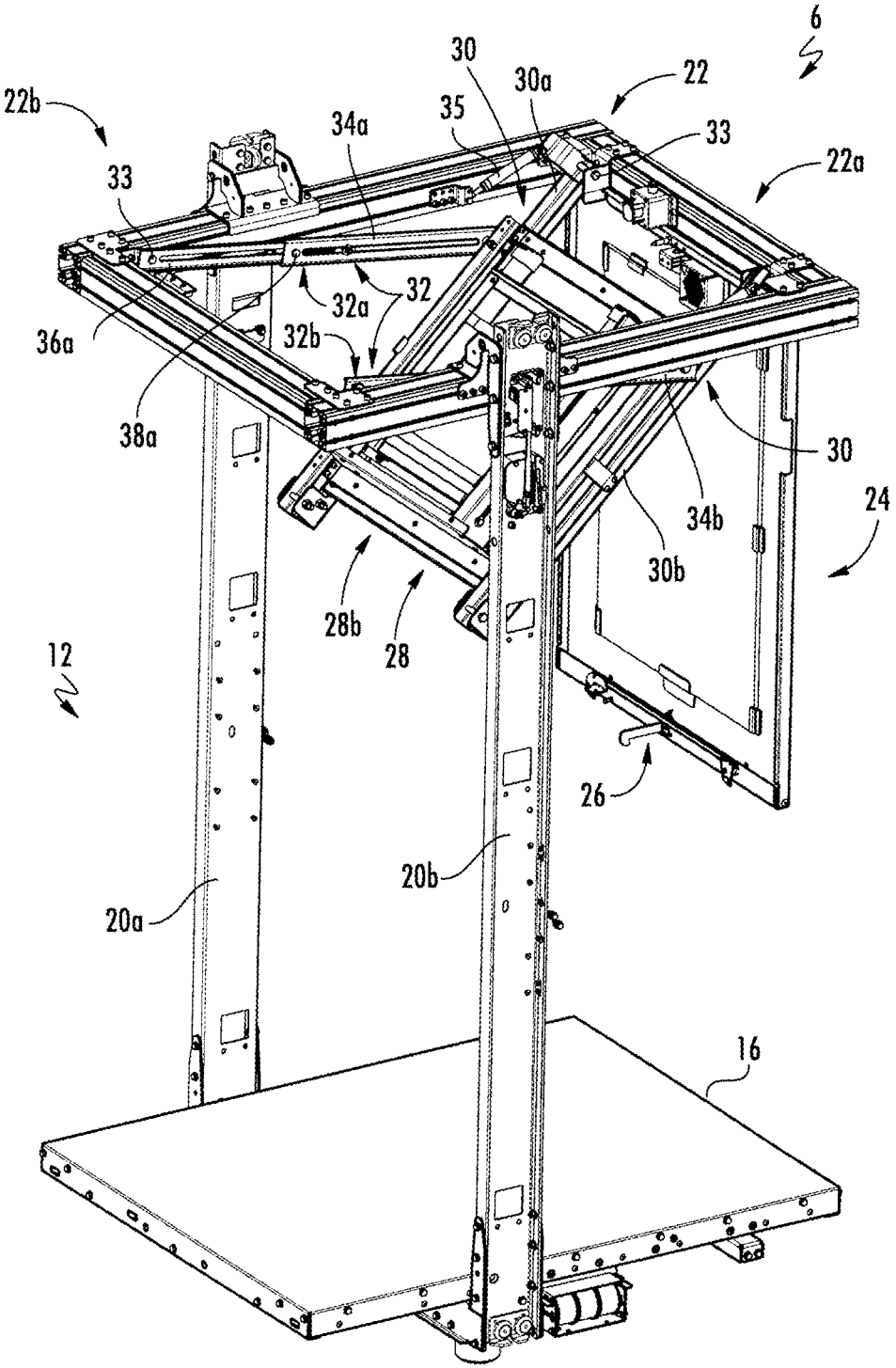
Figure 4:
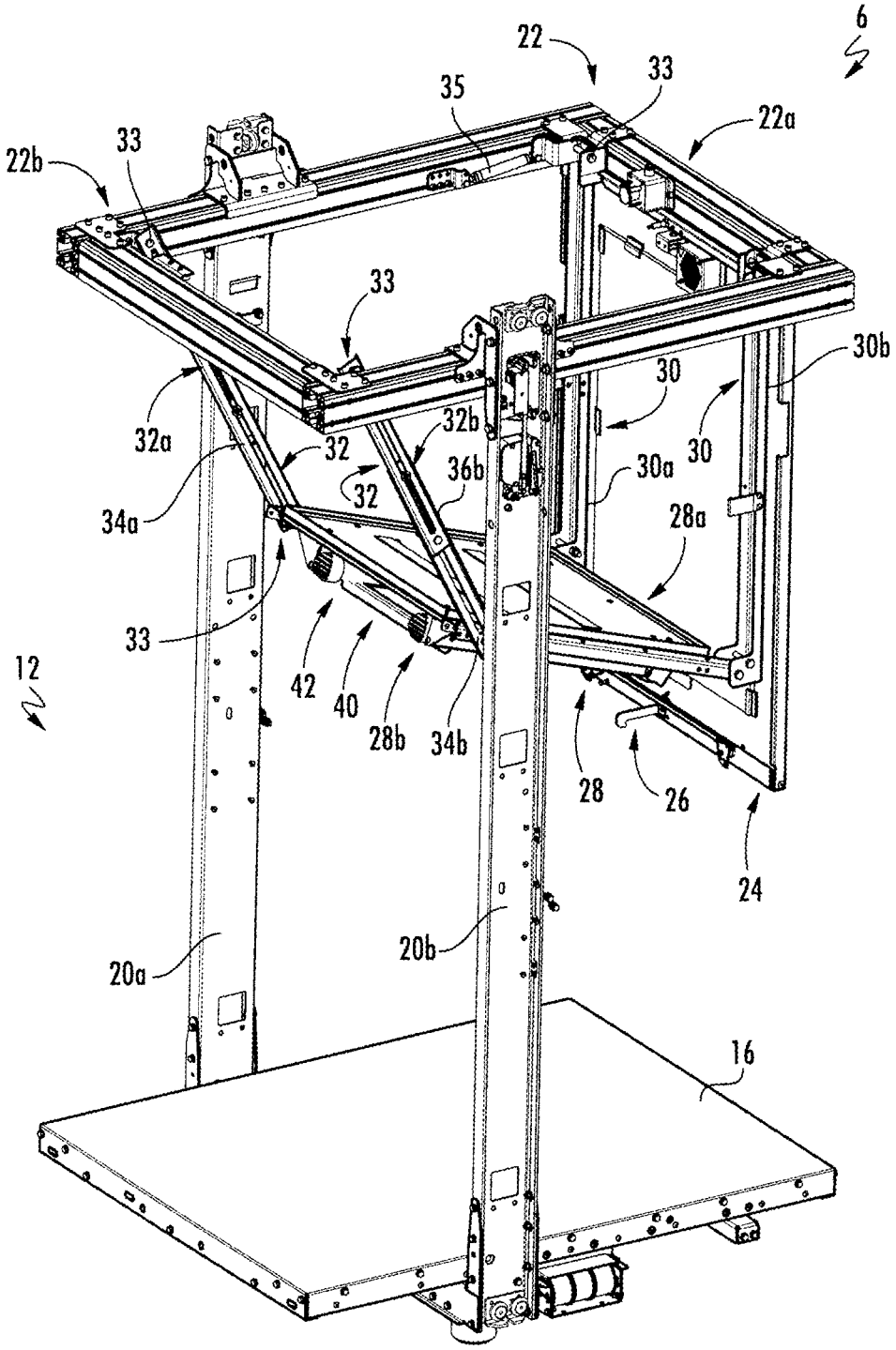

FIGS. 3 and 4 respectively show a perspective view of the elevator car according to an exemplary embodiment of the invention with the working platform being arranged in an intermediate position.

Figure 5:
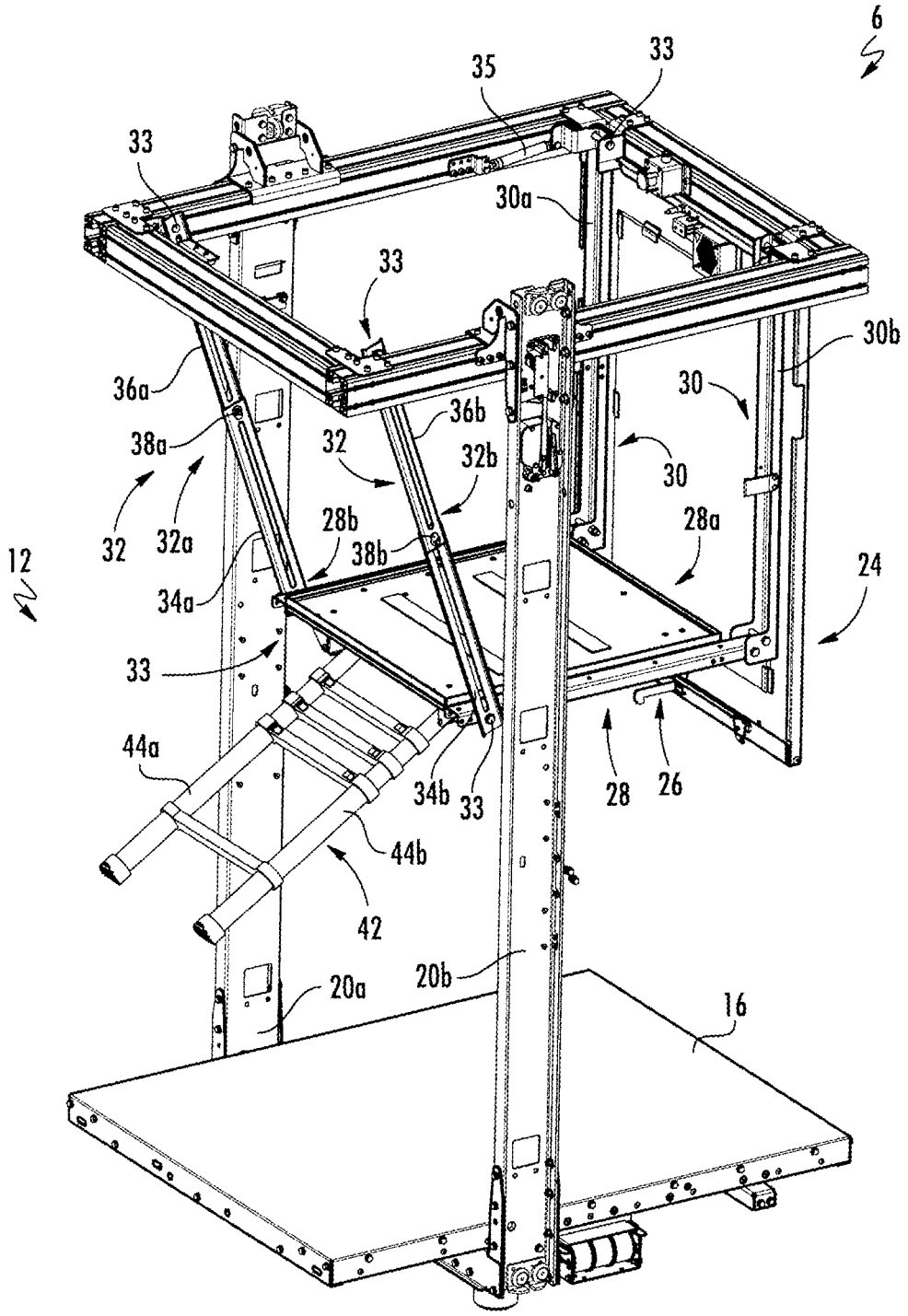
Figure 6:
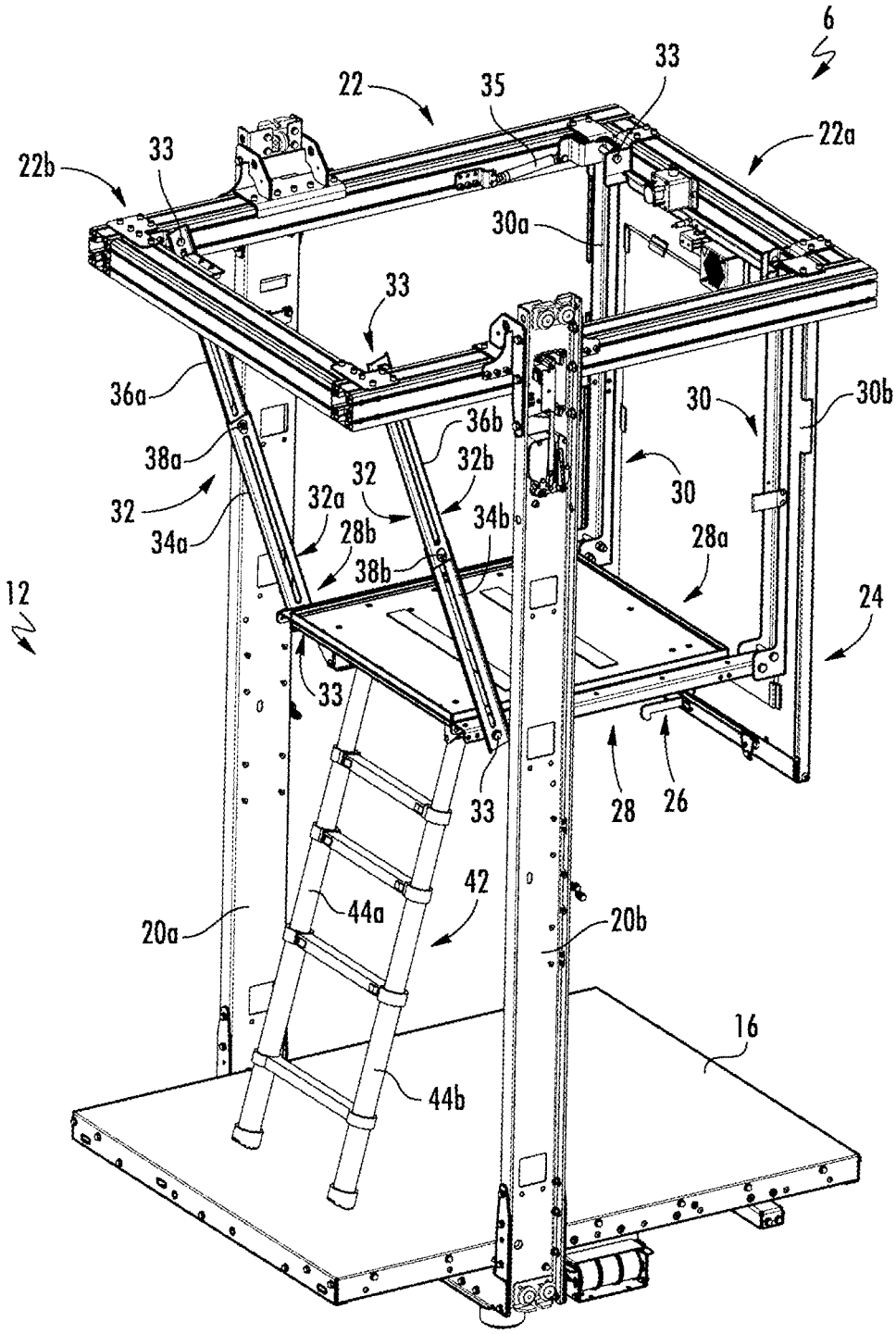

FIGS. 5 and 6 respectively show a perspective view of an elevator car according to an exemplary embodiment of the invention comprising a working platform arranged in a deployed working position.

FIG. 1 schematically depicts an elevator system 2 comprising an elevator car 6 according to an exemplary embodiment of the invention.

The elevator system 2 comprises a hoistway 4 extending in a longitudinal direction between a plurality of landings 8 located on different floors.

The elevator car 6 comprises a floor 16 and sidewalls 17 extending from the floor 16 and defining an interior space 12 of the elevator car 6. Only one sidewall 17 is depicted in the schematic illustration of FIG. 1.

The elevator car 6 is movably suspended within the hoistway 4 by means of a tension member 3. The tension member 3, for example a rope or belt, is connected to a drive 5, which is configured for driving the tension member 3 in order to move the elevator car 6 along the longitudinal direction/height of the hoistway 4 between the plurality of landings 8.

Each landing 8 is provided with a landing door (elevator hoistway door) 10, and the elevator car 6 is provided with a corresponding elevator car door 11 allowing passengers to transfer between a landing 8 and the interior space 12 of the elevator car 6 when the elevator car 6 is positioned at the respective landing 8.

The exemplary embodiment of the elevator system 2 shown in FIG. 1 employs a 1:1 roping for suspending the elevator car 6. The skilled person, however, easily understands that the type of the roping is not essential for the invention and that different kinds of roping, e.g. a 2:1 roping, may be used as well. The elevator system 2 may further include a counterweight (not shown) moving concurrently and in opposite direction with respect to the elevator car 6. Alternatively, the elevator system 2 may be an elevator system 2 without a counterweight, as it is shown in FIG. 1. The drive 5 may be any form of drive used in the art, e.g. a traction drive, a hydraulic drive or a linear drive. The elevator system 2 may have a machine room or may be a machine room-less elevator system. The elevator system 2 may use a tension member 3, as it is shown in FIG. 1, or it may be an elevator system without a tension member 3, comprising e.g. a hydraulic drive or a linear drive (not shown).

The drive 5 is controlled by an elevator control 18 for moving the elevator car 6 along the hoistway 4 between the different landings 8.

Input to the elevator control 18 may be provided via landing control panels 7*a*, which are provided on each landing 8 close to the elevator landing doors 10, and/or via a car operation panel 7*b* provided inside the elevator car 6.

The landing control panels 7*a* and the car operation panel 7*b* may be connected to the elevator control 18 by means of electrical lines, which are not shown in FIG. 1, in particular by an electric bus, e.g. a field bus such as a CAN bus, or by means of wireless data connections.

In order to determine the current position of the elevator car 6, the elevator car 6 is provided with a position sensor 19. The position sensor 19 may be arranged at the top of the elevator car 6 as shown in FIG. 1. Alternatively, the position sensor 19 may be provided at a side of the elevator car 6 or at the bottom, e.g. below a floor 16, of the elevator car 6.

FIGS. 2 to 6 show perspective views of an elevator car 6 according to an exemplary embodiment of the invention, respectively. In FIGS. 2 to 6 the side walls 17 (cf. FIG. 1) of the elevator car 6 are not shown in order to allow for an unobstructed view into the interior space 12 of the elevator car 6.

The elevator car 6 comprises two structural bars 20*a*, 20*b* extending orthogonally, in particular vertically, from the floor 16 of the elevator car 6. A support frame 22 extending parallel to the floor 16 is mounted to the upper ends of the structural bars 20*a*, 20*b*, i.e. to the ends of the structural bars 20*a*, 20*b* opposite to the floor 16. The skilled person will understand that in alternative configurations, which are not shown in the figures, more than two structural bars 20*a*, 20*b* may be used. Alternatively, the support frame 22 may be supported by the side walls 17 of the elevator car 6 instead of or in addition to the structural bars 20*a*, 20*b*.

The floor 16 and the support frame 22 both have a rectangular shape and basically the same dimensions in the horizontal directions so that the floor 16, the support frame 22 and the side walls 17 extending between the floor 16 and the support frame 22 constitute an elevator car 6 having the shape of a cuboid.

A ceiling element 24 (see FIGS. 3 to 6) is pivotably attached to the support frame 22. The ceiling element 24 basically has the shape and dimensions of an interior opening defined by the support frame 22, so that the ceiling element 24 covers and closes said interior opening when the ceiling element 24 is arranged in a horizontal position, in which it is oriented parallel to the support frame 22, as it is illustrated in FIG. 2.

The ceiling element 24 may support or include illumination elements (not shown), which are configured for illuminating the interior space 12 of the elevator car 6. The bottom side of the ceiling element 24 facing the interior space 12 in particular may be formed as a decorative element providing a pleasant appearance of the ceiling of the interior space 12 of the elevator car 6.

The ceiling element 24 may comprise a fixing element 26, such as a hook, which is configured for engaging with a complementary fixing structure (not shown) of the support frame 22 in order to fix the ceiling element 24 in its horizontal position as depicted in FIG. 2.

In order to prevent an unauthorized movement of the ceiling element 24, the fixing element 26 may be combined with a locking mechanism. The locking mechanism allows releasing the fixing element 26 for moving the ceiling element 24 out of its horizontal position only after unlocking the locking mechanism.

After the fixing element 26 has been released, the ceiling element 24 may be pivoted from its horizontal position (see FIG. 2) into a vertical access position (see FIGS. 3 to 6), in which it extends basically vertically, parallel to the structural bars 20*a*, 20*b* and/or to the side walls 17 of the elevator car 6.

When arranged in said access position, the ceiling element 24 allows accessing a working platform 28, which is movably attached to the support frame 22, from the interior space 12 of the elevator car 6.

The working platform 28 in particular is attached to the support frame 22 by means of a support structure 30. The support structure 30 comprises two rigid bars 30*a*, 30*b* extending parallel to each other. Each of the bars 30*a*, 30*b* is pivotably attached to a first side (right side in FIGS. 2 to 6) 28*a* of the working platform 28 and to a first side (right side in FIGS. 2 to 6) 22*a* of the support frame 22, respectively. The bars 30*a*, 30*b* are arranged opposite to each other on two lateral sides of the working platform 28.

An opposite second side (left side in FIGS. 2 to 6) 28*b* of the working platform 28 is attached to the support frame 22 by means of a linkage 32. The linkage 32 includes two linkage elements 32*a*, 32*b* extending parallel to each other between the second side 28*b* of the working platform 28 and a second side (left side in FIGS. 2 to 6) 22*b* of the support frame 22, which is opposite to the first side 22*a*. The linkage elements 32*a*, 32*b* are arranged opposite to each other on two lateral sides of the working platform 28.

The linkage elements 32*a*, 32*b* are pivotably attached to the working platform 28 and to the support frame 22 by appropriate joints 33.

The length of the linkage elements 32*a*, 32 is variable. Each of the linkage elements 32*a*, 32*b* in particular comprises a first bar 34*a*, 34*b* and a second bar 36*a*, 36*b*. Each bar 34*a*, 34*b*, 36*a*, 36*b* is provided with a slot extending in the longitudinal direction. The two bars 34*a*, 34*b*, 36*a*, 36*b* of each linkage element 32*a*, 32*b* are slidably connected to each other by a pin 38*a*, 38*b* extending through the slots of the bars 34*a*, 34*b*, 36*a*, 36*b*.

A skilled person will understand that alternative configurations of the linkage elements 32*a*, 32 are possible as long as they allow varying the length of the linkage elements 32*a*, 32*b*.

After the ceiling element 24 has been moved into its access position, as it is shown in FIGS. 2 to 6, the working platform 28 may be moved from the retracted storage position, in which it is arranged inside and/or above the support frame 22 (see FIG. 2) into the deployed working position (see FIGS. 5 and 6), in which the working platform 28 is positioned in a horizontal orientation within the interior space 12 of the elevator car 6. When the working platform 28 is positioned in the deployed working position, a mechanic may position himself on the working platform 28 in order to access the hoistway 4, in particular components within the hoistway 4, above the elevator car 6 through the opening defined by the support frame 22.

In the following, the movement of the working platform 28 from its retracted storage position shown in FIG. 2 into its deployed working position shown in FIGS. 5 and 6 is explained in more detail with reference to FIGS. 3 to 6.

When positioned in its retracted storage position (FIG. 2) the working platform 28, the linkage elements 32*a*, 32*b* and the bars 30*a*, 30*b* of the support structure 30 are all arranged basically parallel to the (horizontal) plane of the support frame 22.

In a first motion (see FIG. 3), the working platform 28 and the support structure 30 are pivoted together from said retracted storage position into the interior space 12 of the elevator car 6. During said first motion, the working platform 28 is still arranged parallel to the bars 30*a*, 30*b* of the support structure 30.

The linkage elements 32*a*, 32*b* extend, i.e. increase their lengths, and pivot with respect to the support frame 22 and with respect to the working platform 28 in order to adjust for the movement of the working platform 28.

In a second motion (see FIG. 4), the working platform 28 is pivoted with respect to the support structure 30, in order to move the working platform 28 into its final deployed working position, in which the working platform 28 extends basically horizontally parallel to the floor 16 of the elevator car 6 (see FIGS. 5 and 6). Again, the linkage elements 32*a*, 32*b* change their lengths and pivot with respect to the support frame 22 and with respect to the working platform 28, respectively, in order to adjust for the changing position of the second side 28*b* of the working platform 28 with respect to the second side 22*b* of the support frame 22 to which the linkage elements 32*a*, 32*b* are mounted.

Depending on the specific configuration, i.e. depending on the dimensions of the working platform 28, the support structure 30 and the linkage elements 32*a*, 32*b*, the second motion, i.e. the motion of the working platform 28 with respect to the support structure 30, may start only after the first motion has been completed, i.e., after the support structure 30 extends basically vertically from the support frame 22 into the interior space 12 of the elevator car 6. In such a configuration, the working platform 28 is oriented basically orthogonally with respect to the support frame 22 and the floor 16 of the elevator car 6, i.e. parallel to the structural bars 20*a*, 20*b* and/or to the side walls 17 of the elevator car 6, after the first motion has been completed and before the second motion is started.

In an alternative configuration, the two motions may at least partially overlap, i.e., the second motion may be started before the first motion has been completed, i.e., before the support structure 30 extends basically vertically from the support frame 22 into the interior space 12 of the elevator car 6.

In both configurations, the working platform 28 is moved through an intermediate position, in which it is arranged in an inclined orientation with respect to the support frame 22 and with respect to the floor 16 of the elevator car 6 during the motion (see FIG. 4).

The support structure 30 and/or the linkage elements 32*a*, 32*b* may be provided with dampers 35 which are configured for damping their movements in order to allow an easy, smooth and well controlled movement of the working platform 28 between the retracted storage position and the deployed working position.

In the exemplary configuration shown in the figures, a storage space 40 (cf. FIG. 4) is formed within/under the working platform 28. The storage space 40 in particular may be configured for accommodating a ladder 42, which allows a mechanic to climb onto the working platform 28 more easily.

The ladder 42 in particular may be a telescopic ladder 42 comprising two telescopic bars 44*a*, 44*b*, which may be selectively compressed in order to allow storing the ladder 42 within the storage space 40 (see FIGS. 4 and 5) and expanded in order to extend the ladder 42 to the distance between the floor 16 of the elevator car 6 and the working platform 28 (see FIG. 6).

While the invention has been described with reference to exemplary embodiments, it will be understood by those skilled in the art that various changes may be made and equivalents may be substituted for elements thereof without departing from the scope of the invention. In addition, many modifications may be made to adopt a particular situation or material to the teachings of the invention without departing from the essential scope thereof. Therefore, it is intended that the invention is not limited to the particular embodiments disclosed, but that the invention includes all embodiments falling within the scope of the claims.

REFERENCES

2 elevator system
3 tension member
4 hoistway
5 drive
6 elevator car
7*a* landing control panel
7*b* car operation panel
8 landing
10 landing door
11 elevator car door
12 interior space of the elevator car
16 floor of the elevator car
17 sidewall of the elevator car
18 elevator control
19 position sensor
20*a*, 20*b* structural bars
22 support frame
22*a* first side of the support frame
22*b* second side of the support frame
24 ceiling element
26 fixing element
28 working platform
28*a* first side of the working platform
28*b* second side of the working platform
30 support structure
30*a*, 30*b* bars of the support structure
32 linkage
32*a*, 32*b* linkage elements
33 joint
34*a*, 34*b* first bar of the linkage element
35 damper
36*a*, 36*b* second bar of the linkage element
38*a*, 38*b* pins
40 storage space
42 ladder
44*a*, 44*b* bars of the ladder

What is claimed is:

1. An elevator car defining an interior space for accommodating passengers and comprising a support frame positioned on a top side of the interior space;

a support structure pivotably mounted to the support frame; and a working platform pivotably mounted to the support structure;

wherein the support structure is pivotable with respect to the support frame and the working platform is pivotable with respect to the support structure between a retracted position and a deployed position, in the deployed position the support structure extends away from the support frame towards the interior space and the working platform extends away from the support structure;

a linkage connected to the support frame and to the working platform, wherein a first side of the working platform is connected to the support structure, and an opposing second side of the working platform is pivotably connected to the linkage.

2. The elevator car according to claim 1, wherein the working platform is movable between the retracted storage position and the deployed working position through at least one intermediate position, in which the working platform is inclined with respect to the support frame.

3. The elevator car according to claim 1, wherein the working platform in its deployed position extends orthogonally from the support structure and/or wherein the support structure extends orthogonally from the support frame when the working platform is positioned in its deployed position.

4. The elevator car according to claim 1, wherein a length of the linkage is variable.

5. The elevator car according to claim 4, wherein the linkage comprises a telescopic linkage.

6. The elevator car according to claim 1, wherein the linkage is pivotably connected to the support frame.

7. The elevator car according to claim 1, wherein the linkage comprises two linkage elements.

8. The elevator car according to claim 7, wherein the two linkage elements are attached to two opposite sides of the working platform.

9. The elevator car according to claim 1, wherein the working platform comprises a storage space for accommodating a ladder.

10. The elevator car according to claim 9, wherein the ladder comprises a telescopic ladder.

11. The elevator car according to claim 9, wherein the storage space is formed in a lower portion of the working platform.

12. The elevator car according to claim 1, wherein the support structure and/or the working platform are lockable in at least one of their retracted and deployed positions.

13. The elevator car according to claim 1, further comprising a ceiling element pivotably attached to the support frame.

14. The elevator car according to claim 13, wherein the ceiling element is positionable between the working platform and the interior space, when the working platform is oriented in its retracted position.

15. The elevator car according to claim 14, wherein the ceiling element is lockable when arranged between the working platform and the interior space.

16. An elevator system comprising at least one elevator car according to claim 1.

17. A method of moving the working platform in the elevator car according to claim 1, wherein the method comprises pivoting the support structure with respect to the support frame and pivoting the working platform with respect to the support structure.

* * * * *